US006945487B1

(12) United States Patent
Obitz

(10) Patent No.: US 6,945,487 B1
(45) Date of Patent: Sep. 20, 2005

(54) FEEDING APPARATUS FOR CELLULOSIC MATERIAL

(76) Inventor: Lars Obitz, Isterberget 3, Vaxholm (SE) S-185 00

( * ) Notice: Subject to any disclaimer, the term of this patent is extended or adjusted under 35 U.S.C. 154(b) by 405 days.

(21) Appl. No.: 09/666,326

(22) Filed: Sep. 21, 2000

(30) Foreign Application Priority Data

Sep. 23, 1999 (SE) ..... 9903448

(51) Int. Cl.[7] ..... B02C 19/12
(52) U.S. Cl. ..... 241/260.1; 241/277
(58) Field of Search ..... 241/260.1, 278.1, 241/277

(56) References Cited

U.S. PATENT DOCUMENTS 4,249,703 A * 2/1981 Korenev et al. ..... 241/247
4,838,995 A * 6/1989 Klausen ..... 162/18
4,986,480 A 1/1991 Gullichsen et al.
4,999,063 A * 3/1991 Vos et al. ..... 149/109.6
5,148,998 A 9/1992 Obitz
6,145,766 A * 11/2000 Mraz et al. ..... 241/74

* cited by examiner

*Primary Examiner*—Mark Rosenbaum
(74) *Attorney, Agent, or Firm*—Dowell & Dowell, P.C.

(57) ABSTRACT

An apparatus for pressure tight discharge of refiner material, such as cellulosic material by using a screw which feeds the material between a screw shaft and screw housing whereby a pressure tight material plug is formed at an outlet of the screw housing. The screw is, at the out end, provided with a flange which together with a throttle journalled around the flange forms an adjustable outlet opening through which material is fed out by the screw while the material forms a pressure tight material plug.

12 Claims, 2 Drawing Sheets

26
24
40
28
30
32
18
20
22

FEEDING APPARATUS FOR CELLULOSIC MATERIAL

BACKGROUND OF THE INVENTION

1. Field of the Invention

The present invention concerns a feeding apparatus for cellulosic material in which a screw feeds and compresses the material between a screw shaft and screw housing for the build-up of a pressure tight material plug.

2. Brief Description of the Related Art

In treatment of cellulosic material, such as refining in a grinding apparatus, steam is formed, which is separated from the material, retaining its high pressure, to be utilized separately in the process. However, discharge of the material separated from the steam is done at a lower pressure, such as atmospheric pressure. In order to prevent the steam from leaving with the material and to maintain the high pressure of the steam, the material must be fed out through sluice means of any kind. Another way to seal the steam separating portion from the discharge of the material is to allow the material at the discharge to form a pulp plug, which seals the outlet so that the steam will not be entrained in the material when discharged.

In known outlet means of the latter type, the material is provided to fall down into a screw, which is, in one end, provided with drive means and in the opposite end feeds the material towards a throttling opening so that the material plug is formed. Since the driving is provided on the pressure side, the drive means must be sealed by means of pack boxes or the like, which wear out and require maintainance and possibly replacing. The plug is also formed in the end of the relatively long screw, which is opposite to the drive means, wherefore the higher load on this end of the screw makes the screw unstable. This also limits the possibilities to control the forming of the plug depending on the loading conditions.

OBJECT OF THE INVENTION

The main object of the invention is to provide a feeding apparatus in which the drawbacks of the known apparatuses are eliminated.

This object is met by giving the apparatus the features of the following claims.

BRIEF DESCRIPTION OF THE DRAWINGS

The present invention will in the following be described in more detail in connection with an example of embodiment shown in the drawings.

DESCRIPTION OF THE PREFERRED EMBODIMENT

Figure 1:
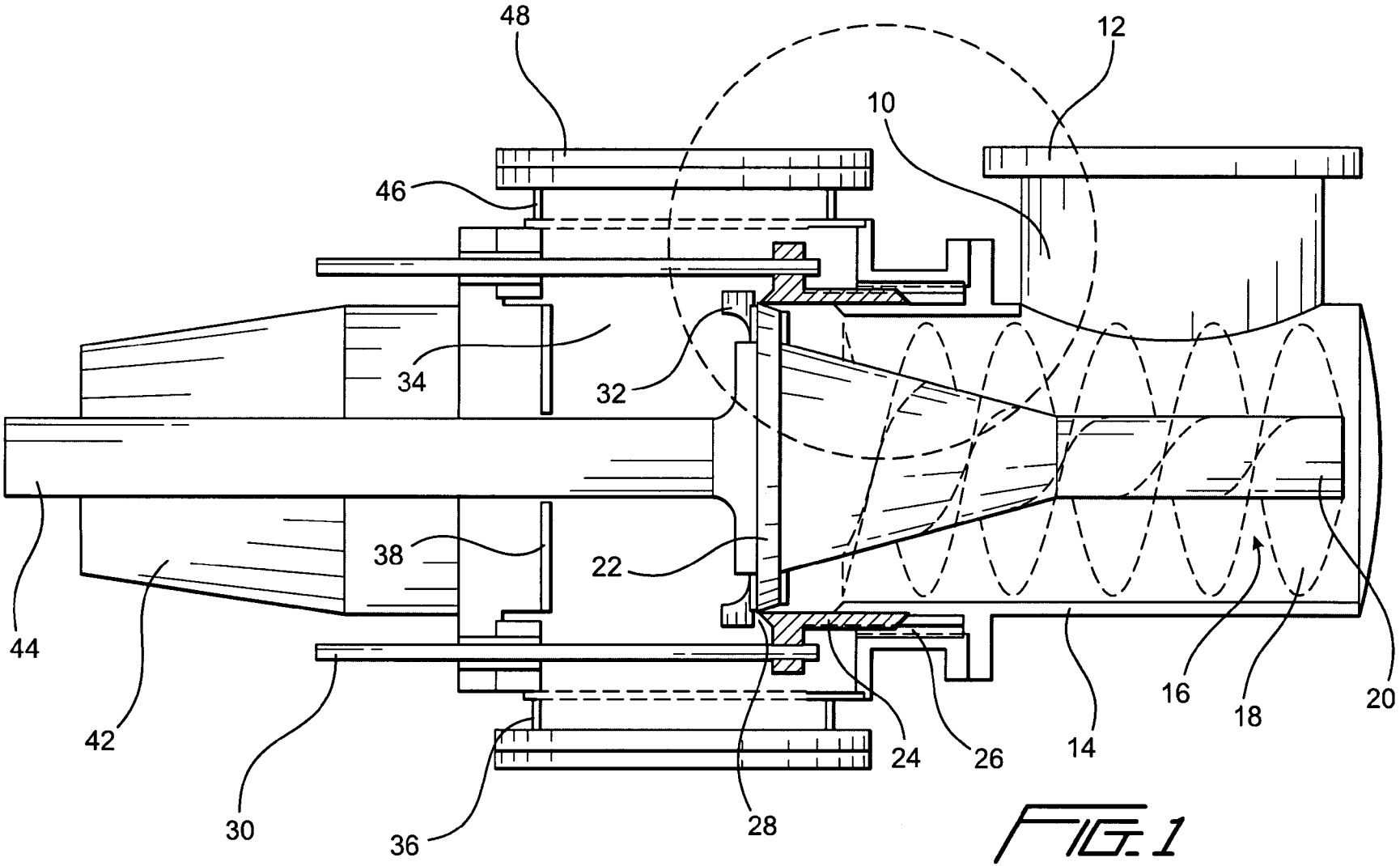
FIG. 1 shows a side view, partly in cross section, of a feeding apparatus according to the invention.
Figure 2:
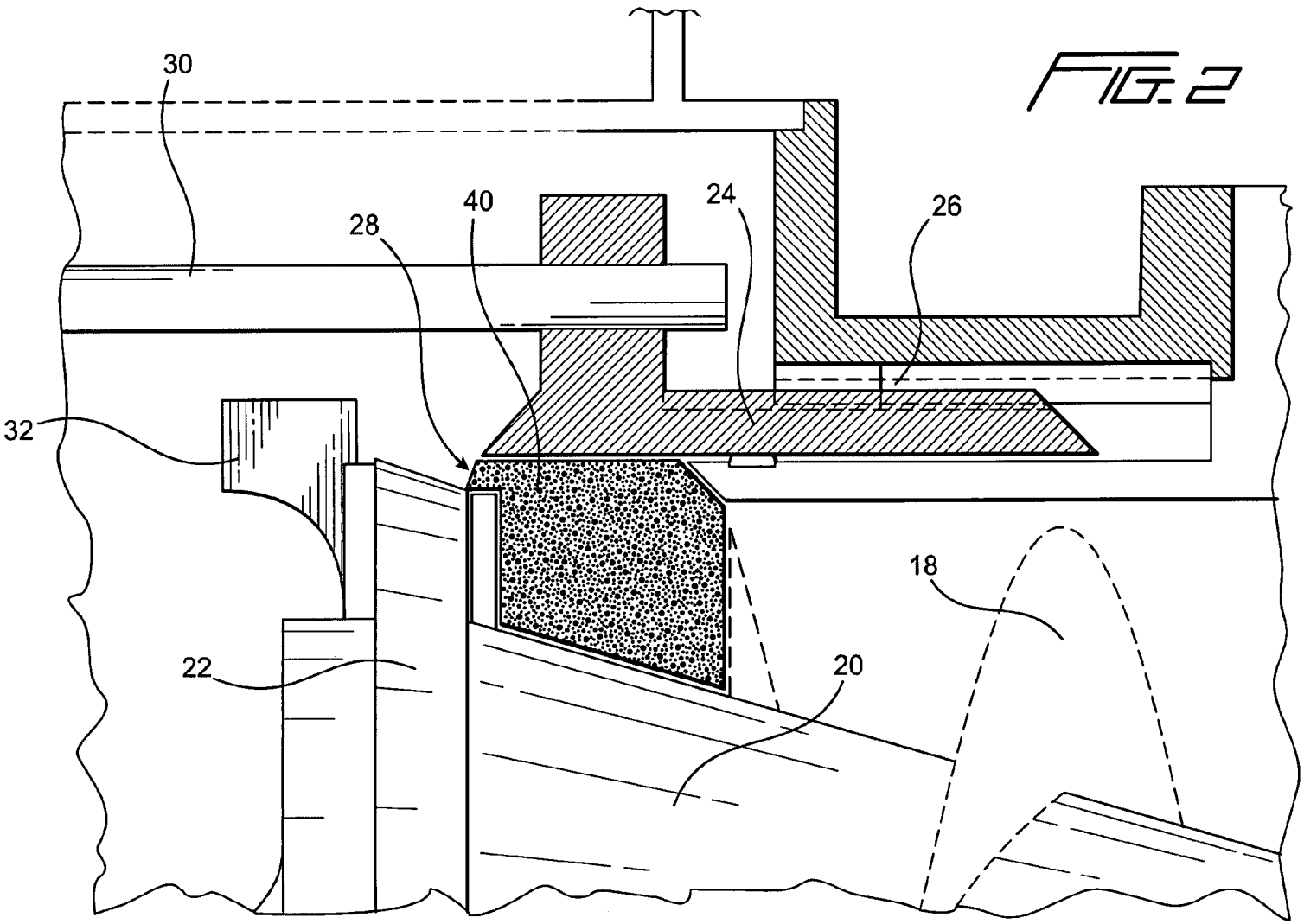
FIG. 2 shows in an enlarged scale a detail of the encircled portion of the apparatus of FIG. 1.

The apparatus comprises a connection piece or inlet 10 which, by a flange 12, is connected in a pressure tight manner to the outlet of a stream separator, for example of the type shown in the Swedish patent 9101342-5 (corresponding to U.S. Pat. No. 5,148,998), so that the material, such as pulp, is fed to the inlet 10 when the steam generated during the refining has been separated in the steam separator and under pressure passed to different uses in the process, such as heating of water. In order to prevent a decrease or loss of the pressure of the steam, the pulp must, after the steam separating step, be fed out in a pressure tight way. For this, the pulp falls down into a sealed housing 14, provided under the inlet 10, in which housing 14 a transporter screw 16 with flights 18 is provided on a shaft 20. The shaft 20 has a conical peripheral portion having an increasing diameter towards the outlet end of the screw housing, i.e. in the direction of the feeding of the material transported by the screw 16 to direct the material out towards the inner periphery of the housing. At the outlet end, the shaft 20 is further provided with a flange 22, which has a conically increasing diameter in the feeding direction. Around flange 22 a plug pipe 24 is provided, which is movably journalled to the housing 14 and which at one end is displaceably journalled around the outside of the housing, so that the plug pipe may be displaced towards and away from the flange 22 for forming an outlet gap 28 for the material. The displacement is carried out by operating rods 30 connected to the plug pipe 24 and which are operated by suitable drive motors (not shown) to displace the plug pipe in a preferred direction and in this way change the size of the gap 28. The plug pipe 24 thus forms an adjustable throttle to central passage of material through the outlet opening 28.

The operating rods 30 are controlled and mounted in openings in a bearing house 42 for the shaft of the screw. In the gap 28 a controllable counter pressure is developed against the feeding of the material occurs in this way, which causes the formation of a material plug 40 before the flange 22, which material plug 40 seals the interior of the housing 14 from the space 34 outside of the flange 22. On the outside of the flange 22, seen in the direction of feeding, wings 32 are provided, which are provided to cut up the annular material plug which is fed out of the gap 28 to space 34, so that the material falls down to the bottom of the space 34. This bottom is open downwards and provided with a connection piece 36 intended for connection to any means for further transport of the material. A distance from and opposite the outlet gap 28, the space 34 is limited by a sealing wall 38, which sealingly surrounds an extension 44 of the shaft 20, which shaft extension 44 is journalled in the gearing house 42 and is provided to be connected to a drive motor (not shown) for the screw 16. the space 34 has a connection piece 46 at the top, which is provided with an inspection cover 48.

The described apparatus works in the following way: The pulp, which comes from the steam separator (not shown) to the inlet 12, falls down into and is fed by the screw 16 towards the outlet of the housing 14, i.e. in the left hand direction in FIG. 1, and will be forced by the conically increasing axle 20 towards the inner periphery of the housing 14 so that a pulp plug 40 will be formed before the pulp outlet, which is limited by the flange 22 provided on the axle 20. To control the discharge of the pulp plug 40 and thus retaining a pressure tight function of the plug 40, the size of the outlet opening 28 is controlled according to the invention by means of the journalled plug pipe 24, of which the motion is controlled by the operating rods 30. The annular pulp plug discharged through the opening 28 will, if it is not falling apart by itself, be beaten apart by wings 32 provided on the outside of the opening 28 and rotating with the shaft 20. The pulp then falls down into the lower portion of the house 34 and is fed out of the outlet 36 for further processing.

As is evident from the shown embodiment, the shaft 20 of the screw 16 is journalled with its shaft extension 44 in the bearing housing 42, on the side of the housing 14 of the screw 16 where there is atmospheric pressure. In this way there is not any need for pressure tight packing boxes in the bearing housing, which simplifies and reduces the costs for maintainance and operation of the apparatus. By the fact that the bearing 42 of the screw 16 is closest to the end of the screw 16 where the pulp plug 40 is formed, unstability of the screw 16 is prevented to a great extent so that better precision is achieved when setting the size of the outlet opening.

What is claimed is:

1. A feeding apparatus for discharging cellulosic material from a steam separator, the feeding apparatus comprising; a housing having an inlet adapted to be connected to a discharge from the steam separator through which the cellulosic material enters said housing and an outlet through which the cellulosic material leaves said housing, said housing being sealed to prevent loss of steam therefrom between said inlet and said outlet, a screw disposed within said housing which feeds the cellulosic material from said inlet between a peripheral portion of a screw shaft and an inner surface of said housing, said screw shaft including a flanged portion which extends transversely outwardly of said screw shaft toward said outlet and which, together with a throttle means provided radially outwardly thereof, define an opening of said outlet of said housing, and means for adjusting said throttle means relative to said flanged portion so as to adjust a size of the outlet opening to thereby form the cellulosic material into a pressure tight material plug at the outlet opening to thereby prevent loss of steam pressure from the steam separator through the feeding apparatus when the feeding apparatus is connected to the steam separator.

2. The apparatus according to claim 1, wherein said means for adjusting said throttle means includes a plug pipe which is movably journalled to said housing so that said plug pipe may be linearly adjusted relative to said flanged portion of said screw to control the size of the outlet opening.

3. The apparatus according to claim 2, wherein said plug pipe is movably journalled by a spline connection between said plug pipe and said housing.

4. The apparatus according to claim 3 wherein said screw shaft is journalled in a bearing provided outside of said housing.

5. The apparatus according to claim 4, wherein said bearing is provided adjacent the outlet of said housing.

6. The apparatus according to claim 5 wherein said bearing is provided at a distance from said housing and thereby defines a discharge space for the cellulosic material passing through the outlet opening.

7. The apparatus according to claim 5 including wings provided on said screw shaft outside of and adjacent to the outlet opening for breaking up discharged cellulosic material.

8. The apparatus according to claim 4, wherein displacement of said plug pipe is carried out by means of operating rods mounted in said bearing.

9. The apparatus of claim 2 wherein said screw shaft is mounted in a bearing provided beyond said outlet of said housing.

10. The apparatus according to claim 9 wherein said bearing is provided at a distance from said housing and thereby defines a discharge space for the cellulosic material passing through the outlet opening.

11. The apparatus according to claim 2 including wings provided on said screw shaft outside of and adjacent to the outlet opening for breaking up cellulosic material passing through the outlet opening.

12. The apparatus according to claim 1 including wings provided on said screw shaft outside of and adjacent to the outlet opening for breaking up cellulosic material passing through the outlet opening.

* * * * *